United States Patent [19]

Angerer et al.

[11] Patent Number: 4,635,832

[45] Date of Patent: Jan. 13, 1987

[54] METHOD OF, AND AN ARRANGEMENT FOR CASTING METAL MELT

[75] Inventors: Reinhold Angerer; Felix Wallner, both of Linz, Austria

[73] Assignee: Voest-Alpine Aktiengesellschaft, Linz, Austria

[21] Appl. No.: 715,270

[22] Filed: Mar. 25, 1985

[30] Foreign Application Priority Data

Apr. 5, 1984 [AT] Austria ..... 1155/84

[51] Int. Cl.[4] ..... B22D 41/08; G01N 27/74; G01N 27/90

[52] U.S. Cl. ..... 222/590; 222/594; 222/52; 164/453; 164/155; 324/226; 324/232

[58] Field of Search ..... 222/590, 591, 594, 597, 222/601, 602, 52; 164/453, 155, 466, 502; 266/93, 94, 80; 324/204, 226, 233, 234, 236–243

[56] References Cited

U.S. PATENT DOCUMENTS

| | | | |
|---|---|---|---|
| 3,401,780 | 9/1968 | Jullien-Davin | 194/100 R |
| 4,079,918 | 3/1978 | Truppe et al. | 266/45 |
| 4,140,300 | 2/1979 | Gruner et al. | 222/590 X |
| 4,173,299 | 11/1979 | Kollberg et al. | 164/155 X |
| 4,206,775 | 6/1980 | Tanaka | 194/100 A X |
| 4,460,031 | 7/1984 | Wiesinger et al. | 164/150 |
| 4,529,029 | 7/1985 | Block | 164/453 |

FOREIGN PATENT DOCUMENTS

| | | | |
|---|---|---|---|
| 64961 | 5/1980 | Japan | 222/591 |
| 97846 | 7/1980 | Japan | 164/453 |

*Primary Examiner*—Joseph J. Rolla
*Assistant Examiner*—Nils E. Pedersen
*Attorney, Agent, or Firm*—Collard, Roe & Galgano

[57] ABSTRACT

In a method of casting a metal melt from a metallurgical vessel, in which the metal melt is covered by a slag layer, into another metallurgical vessel, the metal melt is guided through a casting tube, which covers the casting jet between the vessels. In order to reliably ascertain the passage of slag through the casting tube with very little expenditure, magnetic fields are induced in the casting jet by two coils peripherally surrounding the casting tube. The difference of the inductivity variations caused in the two coils by the eddy currents produced by the magnetic fields in the casting jet is continuously measured and compared to a least one limit value and casting is interrupted in case the limit has been exceeded or fallen short of.

2 Claims, 3 Drawing Figures

METHOD OF, AND AN ARRANGEMENT FOR CASTING METAL MELT

The invention relates to a method of casting a metal melt from a metallurgical vessel, in which the metal melt is covered by a slag layer, into another metallurgical vessel, the metal melt being guided through a casting tube, which covers the casting jet between the vessels, as well as to an arrangement for carrying out the method.

When casting metal melt through a casting tube, there exists the problem that, towards the end of casting, slag covering the metal melt is teemed through the casting tube together therewith, which often is undesired. This problem is to be faced, in particular, with the continuous casting of steel, because there the penetration of slag into the mold must be prevented in any event.

It is known (U.S. Pat. No. 4,079,918) to prevent slag from running out with the metal melt, by optically observing the casting jet, for instance, by means of a ratio pyrometer. This, however, is not applicable to certain methods of casting, such as to continuous casting, since the casting jet is exposed to the oxygen of air, which may lead to undesired changes in the melt composition.

It is, furthermore, known (U.S. Pat. No. 4,460,031; Austrian Pat. No. 365,497) to prevent slag from running out together with the metal melt, as the latter leaves a metallurgical vessel, by continuously measuring the amount of metal melt and/or slag melt present in the vessel as well as the overall amount, for instance, by means of floating bodies floating on the metal-melt miniscus and by the observation of the slag level. Furthermore, it is known from U.S. Pat. No. 4,460,031 and from Austrian Pat. No. 365,497 to determine the amount of metal melt by induction loops provided in the brickwork of the metallurgical vessel, which is, however, expensive and cumbersome.

The invention aims at avoiding these difficulties and has as its object to provide a method as well as an arrangement for carrying out the method, by which it is possible with very little expenditure to reliably ascertain the passage of slag through a casting tube, wherein even different operation conditions (flow amounts, flow velocities, temperatures, metal deposits on the wall of the casting tube, etc.) may be taken into consideration, and wherein a direct contact with the metal and slag melt is prevented and metallurgical vessels of conventional designs may be used without any modifications.

This object is achieved according to the invention in that magnetic fields are induced in the casting jet by means of two coils peripherally surrounding the casting tube, and the difference of the inductivity variations caused in the two coils by the eddy currents produced by the magnetic fields in the casting jet is continuously measured and compared to at least one limit value, and that casting is interrupted in case the limit value has been exceeded or fallen short of.

Within the casting tube, the casting jet exhibits a turbulent flow by which eddy currents are created. These eddy currents remain approximately constant per time unit with the flow rate unchanged as long as metal melt flows through the casting tube, so that also the difference of the inductivity variations at the coils is approximately constant. As soon as slag has entered the casting tube and has passed the first coil, the difference of the inductivity variations rises; as soon as pure slag flows through the casting tube, the difference returns to zero, because the liquid slag cannot deliver any signal change on account of its low electric conductivity.

By utilizing this phenomenon, casting, preferably, is interrupted after a rise in the difference of the inductivity variations to above a predetermined limit value within a predetermined time interval and a consecutive drop in the difference of the inductivity variations to below a predetermined limit value within a further predetermined time interval.

An arrangement for carrying out the method, comprising a metallurgical vessel from which a casting tube is directed into another metallurgical vessel, is characterized in that the casting tube is peripherally surrounded by two equal coils consecutively arranged in the longitudinal direction of the casting tube, fed by an A.C. power supply and connected in series, the ends of the coils being integrated in a Wheatstone bridge whose bridge diagonal is connected between the coils.

A preferred embodiment is characterized in that the Wheatstone bridge is followed by a mean value rectifier and a peak value rectifier each comprising a phase shifter, the mean value rectifier and the peak value rectifier being connected in parallel, and that both the mean value rectifier and the peak value rectifier are each followed by a comparator, each of the two comparators being connected parallel to the mean value rectifier and the peak value rectifier.

The invention will now be explained in more detail by way of one embodiment and with reference to the accompanying drawings, wherein.

Figure 1:
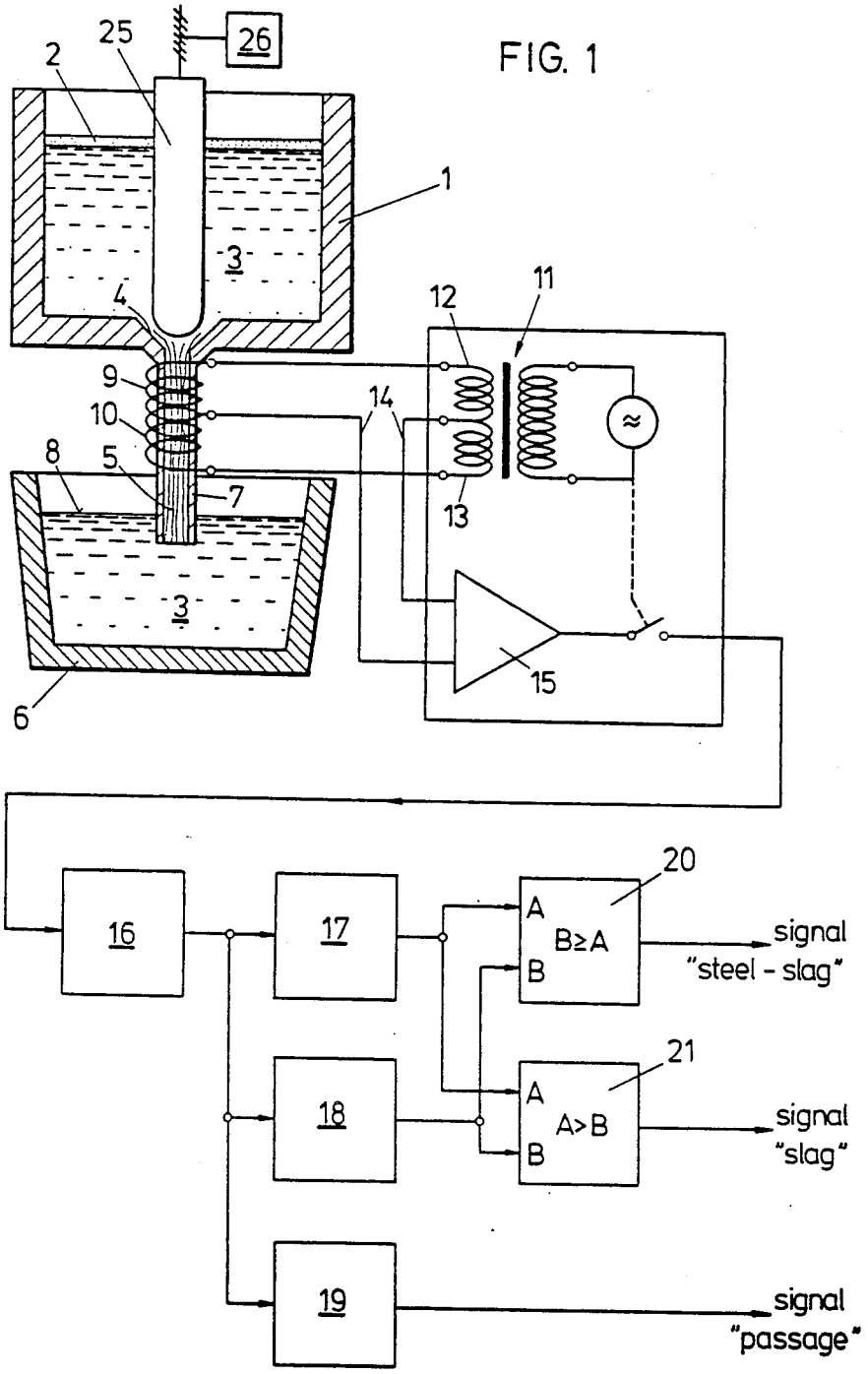
FIG. 1 is a block diagram of an arrangement for carrying out the method according to the invention.

In FIG. 1, a casting ladle 1 is filled with steel melt 3 covered with a slag layer 2. Through a bottom opening 4, the steel melt flows into a tundish 6 disposed below the casting ladle 1 in the form of a casting jet 5, from which tundish the steel melt 3 streams into a mold, which, however, is not illustrated in the drawing.

In order to protect the casting jet 5 from influences by the air oxygen, it is surrounded by a casting tube, or protection tube, 7, which either reaches too closely above the casting level 8 of the tundish 6 or immerses into the steel melt 3 present in the tundish 6. In order to ascertain whether slag 2 runs out through the protection tube towards the end of casting of the steel melt 3 from the casting ladle 1 into the tundish 6, the protection tube 7 is peripherally surrounded by two coils 9, 10, which coils, and this is most essential, are arranged consecutively in the longitudinal direction of the casting tube and are connected in series. They are fed by an A.C. transformer 11, which is supplied with an A.C. voltage of about 5 kHz.

The ends of the coils are integrated in a Wheatstone bridge, whose resistances are constituted by the two coils 9, 10 and by two coils 12, 13 of the transformer 11, also connected in series. The bridge diagonal 14 of the Wheatstone bridge is connected between the two coils 9 and 10 as well as 12 and 13, each connected in series. The output signal rectified from the bridge diagonal 14 via a phase rectifier 15 is transmitted to a high-pass filter 16. From this high-pass filter, the signal is transmitted to two parallelly connected rectifiers, i.e., a mean value rectifier 17 and a peak value rectifier 18, each including a phase shifter and is further transmitted in parallel to a display amplifier 19. The output signal of each rectifier 17, 18 is further transferred to two comparators, 20, 21 connected parallel to each of the two rectifiers 17, 18.

Figure 2:
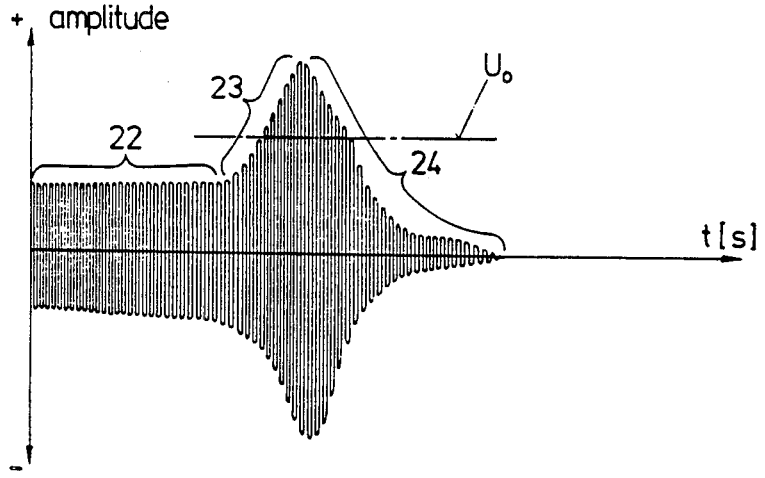
FIG. 2 represents a signal occurring as slag starts to run out together with the metal casting jet.

By way of FIG. 2, the course of a signal at the beginning of the flowing out of slag is explained. At first (as pure steel melt flows out), a signal forming as a result of the eddy formation of the casting jet 5 is observed at a constant height (at 22). As soon as a mixture of steel and slag flows through the casting tube and, thus, through the first one of the coils 9, 10, the signal rises (at 23) (this, because the equilibrium of the Wheatstone bridge has been disturbed by the slag 2 in case slag is present at one of the coils only).

With an increased passage of slag 2, the signal drops (at 24), because the liquid slag 2, on account of its low electric conductivity, cannot deliver any inductivity variations and, thus, no signal changes. As soon as a signal has been observed or detected by means of the comparators 20, 21 as is illustrated in FIG. 2, a closing organ obstructing the bottom opening 4 of the ladle, such as a slide or a stopper 25, is actuated so as to interrupt casting. This may, for instance, be effected by an electric coupling between an electromotor 26, actuating the closing organ and the comparators 20, 21.

The arrangement functions in the following manner:

The metal melt 3 flowing out of the casting ladle 1 through the protection tube 7 forms a turbulent casting jet 5 within the protection tube, which splashes in the protection tube, causing eddies. The magnetic field produced by the two coils 9, 10 provokes eddy currents in the casting jet, which bring about inductivity variations of the two coils 9 and 10. By the two coils being integrated in the Wheatstone bridge, it is possible to continuously measure the difference of the inductivity variations of the coils 9 and 10 by means of the Wheatstone bridge.

The signal emitted from the phase rectifier 15, therefore, is proportional to the difference of the inductivity variations of the two coils 9 and 10. This output signal, in the high-pass filter 16, is freed from slowly fluctuating influencing phenomena, which, for instance, are caused by steel depositing on the inner side of the casting tube or protection tube 7, so that signals that have been triggered by the flow alone, are being processed further. The output of the high-pass filter 16 is monitored by means of the display amplifier 19 with a view to ascertaining whether the arrangement functions correctly and whether a signal of the required quantity exists at all.

The mean value rectifier 17 comprises a phase shifter with a time constant of 15 seconds and the peak value rectifier comprises a phase shifter with a time constant of about 2 seconds. The mean value rectifier forms the mean value of the signal, and it is to be detected if the latter has been exceeded or fallen short of. On multiplying by the factor $\sqrt{2}$, the mean value rectifier delivers an output voltage which, in the case of sinus signals, corresponds to their amplitude. In practice, this is, however, hardly the case.

In parallel, the signal is rectified by a peak value rectifier with a time constant of 2 seconds and is multiplied by 2. There is now the double amplitude of the signal at the output of the peak value rectifier.

By means of potentiometers (not illustrated), the output voltages, between $2U_o$ and $U_o$ and between $U_o$ and 0 are adjusted. These voltages are supplied to the two comparators 20 and 21, whose second inputs are each connected with the mean value output of the mean value rectifier 17.

The output voltage of the mean value rectifier 17, as mentioned above, has a time constant of 15 seconds, i.e., if the voltage changes at the input of the mean value rectifier 17, it takes 15 seconds for the output of the mean value rectifier 17 to follow the voltage change. Contrary thereto, the peak value formation response has a time constant of 2 seconds only.

Figure 3:
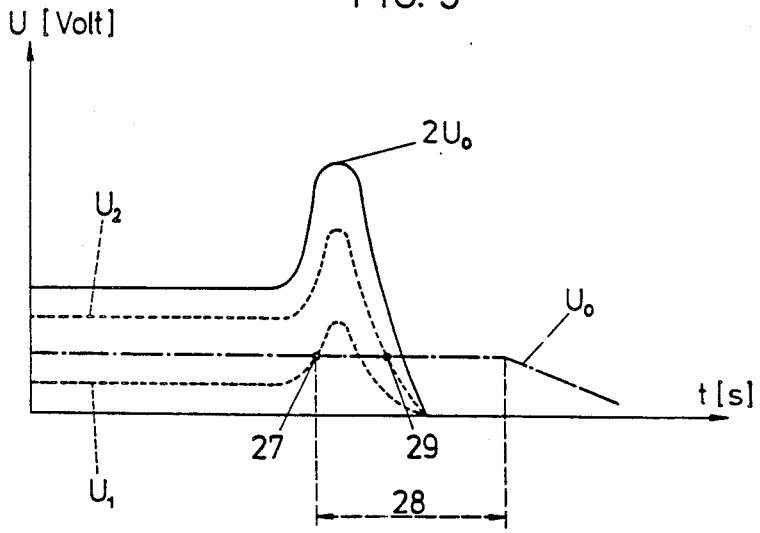
FIG. 3 illustrates the voltage courses at the inputs of the comparators.

If the voltages adjusted at the potentiometers reach the same value as the mean value $U_o$, the comparators give alarm. The potentiometers are adjusted to 50%. With a rise 23 of the signal, the peak value voltage $U_1$ at one potentiometer changes, intersecting with the mean value $U_o$ (at 27) with a 50% voltage rise, the first comparator 20 giving alarm ($B \geqq A$). With a subsequent drop of the peak value by 50% within a predetermined time interval 28, the second comparator 21 gives alarm $A \geqq B$, because the voltage $U_2$ at the second potentiometer reaches the mean value (at 29) (cf. FIG. 3).

By the method according to the invention, it is possible to completely teem off the molten steel and to retain just slag 2 in the casting ladle 1 at the end of casting. The invention has the advantage that, by the coils 9, 10 peripherally surrounding the casting tube 7, a very strong output signal is obtained, that this ouput signal is only negligibly falsified by steel depositing in the casting tube, and that even with high operation temperatures (about 850° C.) non-falsified measured results are obtained, wherein cooling of the coils 9, 10 is unnecessary.

The invention is not limited to the exemplary embodiment illustrated, but it may be modified in various aspects. For instance, it is also possible to monitor the metal melt (steel melt) flowing from a tundish 6, via a casting tube, into the mold of a continuous casting plant.

What we claim is:

1. A method of casting metal melt from a first metallurgical vessel, in which the metal melt is covered by a slag layer, into a second metallurgical vessel in the form of a casting jet guided through a casting tube provided between said first and said second vessels and covering said casting jet, which method comprises the steps of inducing magnetic fields in said casting jet by two coils peripherally surrounding said casting tube so as to cause inductivity variations in said two coils on account of eddy currents produced in said casting jet by said magnetic fields, continuously measuring the difference of said inductivity variations and comparing it to at least one limit value, and interrupting casting after a rise in the difference of the inductivity variations to above a predetermined limit value within a predetermined time interval and a consecutive drop in the difference of the inductivity variations to below a predetermined limit value within a further predetermined time interval.

2. In an arrangement for casting metal melt from a first metallurgical vessel, in which the metal melt is covered by a slag layer, into a second metallurgical vessel in the form of a casting jet and of the type including a casting tube directed from said first metallurgical vessel into said second metallurgical vessel, the improvement which comprises two equal coils peripherally surrounding said casting tube and consecutively arranged in the longitudinal direction of said casting tube and connected in series, an A.C. power supply for feeding said two coils so as to induce magnetic fields in said casting jet to cause inductivity variations in said two coils on account of eddy currents produced in said casting jet by said magnetic fields, a Wheatstone bridge adapted to integrate the ends of said two coils and including a bridge diagonal connected between said two coils, a mean value rectifier and a peak value rectifier following said Wheatstone bridge and each including a phase shifting means, said means value rectifier and said peak value rectifier being connected in parallel, a first comparator following said mean value rectifier and a second comparator following said peak value rectifier, said first and said second comparators being connected parallel to said mean value rectifier and said peak value rectifier.

* * * * *